US005620353A

United States Patent [19]

Lai

[11] Patent Number: 5,620,353

[45] Date of Patent: Apr. 15, 1997

[54] LIQUID BALL CAPABLE OF PROVIDING A DYNAMIC VIEW

[75] Inventor: Tong-Kwung Lai, Hsin Chu Hsien, Taiwan

[73] Assignee: Szu Woei Co., Ltd, Hsin Chu Hsien, Taiwan

[21] Appl. No.: 589,070

[22] Filed: Jan. 23, 1996

[51] Int. Cl.[6] ..... A63H 33/26

[52] U.S. Cl. ..... 446/136; 446/135; 40/411; 40/410

[58] Field of Search ..... 446/136, 135, 446/134, 236; 40/426, 409, 410, 411, 414

[56] References Cited

U.S. PATENT DOCUMENTS

| | | | |
|---|---|---|---|
| 4,970,810 | 11/1990 | Liou | 40/411 |
| 5,134,795 | 8/1992 | Wang | 446/236 |
| 5,226,845 | 7/1993 | Wu | 40/414 |
| 5,435,086 | 7/1995 | Huang | 40/426 |
| 5,458,012 | 10/1995 | Liu | 40/409 |

*Primary Examiner*—Robert A. Hafer
*Assistant Examiner*—Justine Yu
*Attorney, Agent, or Firm*—Bacon & Thomas

[57] ABSTRACT

A liquid ball capable of providing dynamic view. The liquid ball includes a ball portion containing liquid and a magnet-containing ornament, and a base portion supporting the ball portion and defining an inner space for accommodating a driving mechanism. The driving mechanism includes a main spring barrel or a motor and a gearset. Two gears of the gearset mesh with toothed surfaces of two decorative ring members on an outer surface of the base portion and rotate the ring members. A central gear of the gearset closely below the ball portion is connected at a top end of its rotary shaft with a radially extending arm member. Two magnets are attached to two ends of the arm member, with different magnetic poles at their top side. When the arm member rotates along with the gearset, the two magnets produce a changeable magnetic field to revolve and rotate the magnet-containing ornament in the liquid inside the ball portion.

1 Claim, 4 Drawing Sheets

LIQUID BALL CAPABLE OF PROVIDING A DYNAMIC VIEW

BACKGROUND OF THE INVENTION

Liquid ball is a conventional decoration and gift which constantly shares a considerably large market in the world for a long time. However, the presently competitive gift market requires the conventional liquid ball to have improved design to appeal the consumers. With this purpose, the conventional liquid ball with fixed and stationary internal ornament is now changed to contain movable ornament or ornaments to show a dynamic view.

SUMMARY OF THE INVENTION

A primary object of the present invention is to provide a liquid ball capable of providing a dynamic view. The liquid ball uses one single spring barrel or motor to generate necessary dynamics to rotate a set of gears. Two of the gears bring two decorative ring members of the ball base to rotate, and a central gear connecting an arm member having two magnets with different magnetic poles at two upper sides thereof rotates to cause the magnets to produce a changeable magnetic field. The magnetic field causes a magnet-contained ornament to revolve and rotate on the liquid inside the ball.

The liquid ball capable of providing dynamic view according to the present invention therefore mainly includes a ball portion containing liquid and a magnet-contained ornament, and a base portion supporting the ball portion and defining an inner space for accommodating a driving mechanism. The driving mechanism includes a main spring barrel or a motor and a gearset. Two gears of the gearset mesh with toothed surfaces of two decorative ring members on an outer surface of the base portion and drive the ring members to rotate. A central gear of the gearset closely below the ball portion is connected at a top end of its rotary shaft with a radially extended arm member. To two ends of the arm member, two magnets are attached with different magnetic poles at their top side, whereby when the arm member rotates along with the gearset, the two magnets produce a changeable magnetic field to bring the magnet-contained ornament to revolve and rotate on the liquid inside the ball portion.

DETAILED DESCRIPTION OF THE PREFERRED EMBODIMENT

Figure 1:
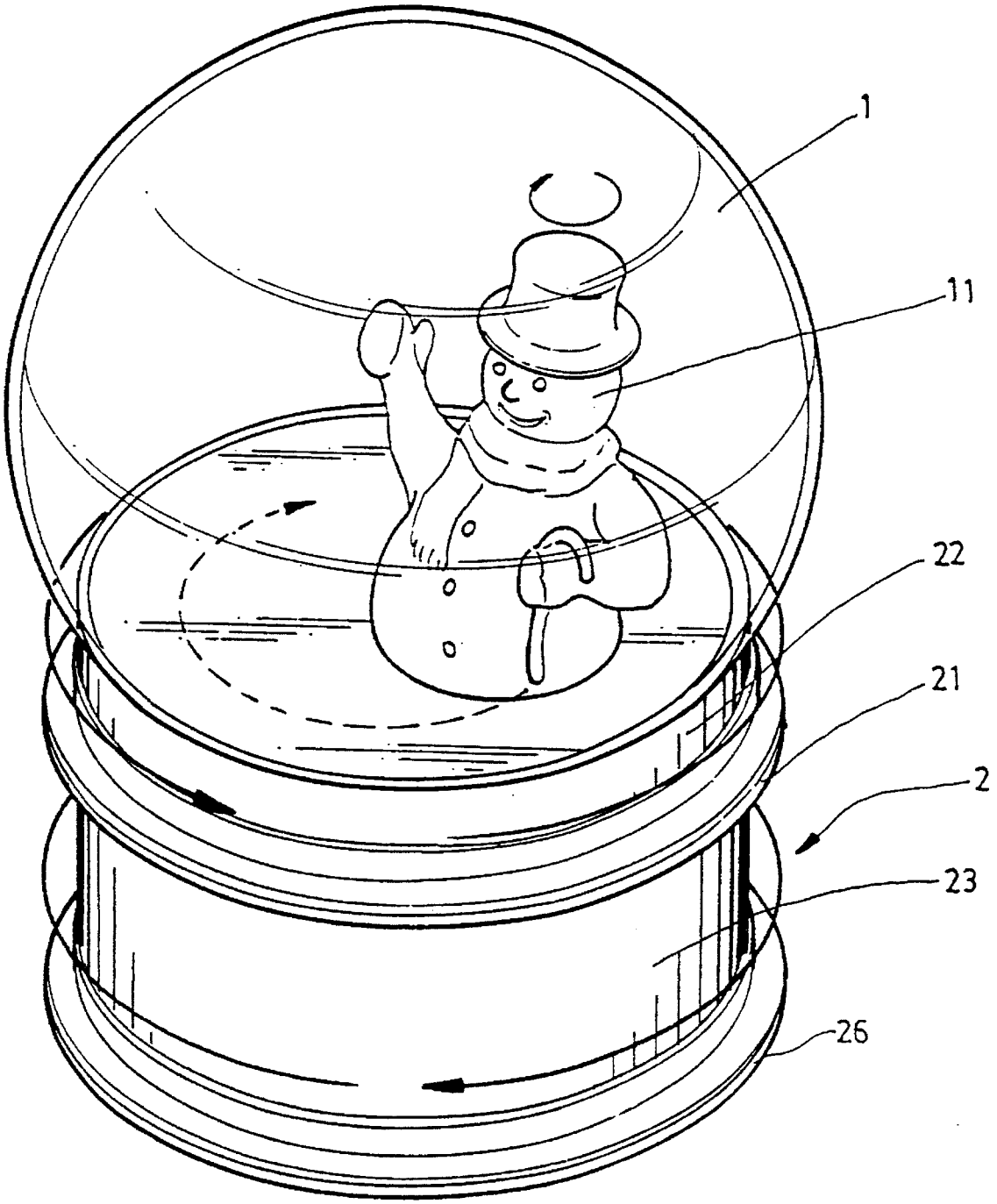
FIG. 1 is a perspective view showing an embodiment of the present invention.

Please refer to FIG. 1. The present invention relates to a decoration usually referred to as a "Liquid Ball" which mainly includes a ball portion 1 containing some kind of liquid therein, a base portion 2 attached to a bottom side of the ball portion 1, and a driving mechanism 3 accommodated inside the base portion 2. When a main spring barrel

31 or a motor of the driving mechanism 3 is turned on, an inner ornament 11 inside the ball portion 1 is caused to revolve along a path as shown by the dotted arrow. The ornament 11 also rotates while it is revolving, showing a dynamically changeful view. The base portion 2 is divided by a middle partition member 21 into an upper ring member 22 and a lower ring member 23. Both the upper and the lower ring members 22, 23 can be driven to rotate at an adequate speed. When the two ring members are provided with different pattern designs, their rotation together with the moving inner ornament 11 in the ball portion 1 shall largely increase the decorative effect of the liquid ball.

Figure 2:
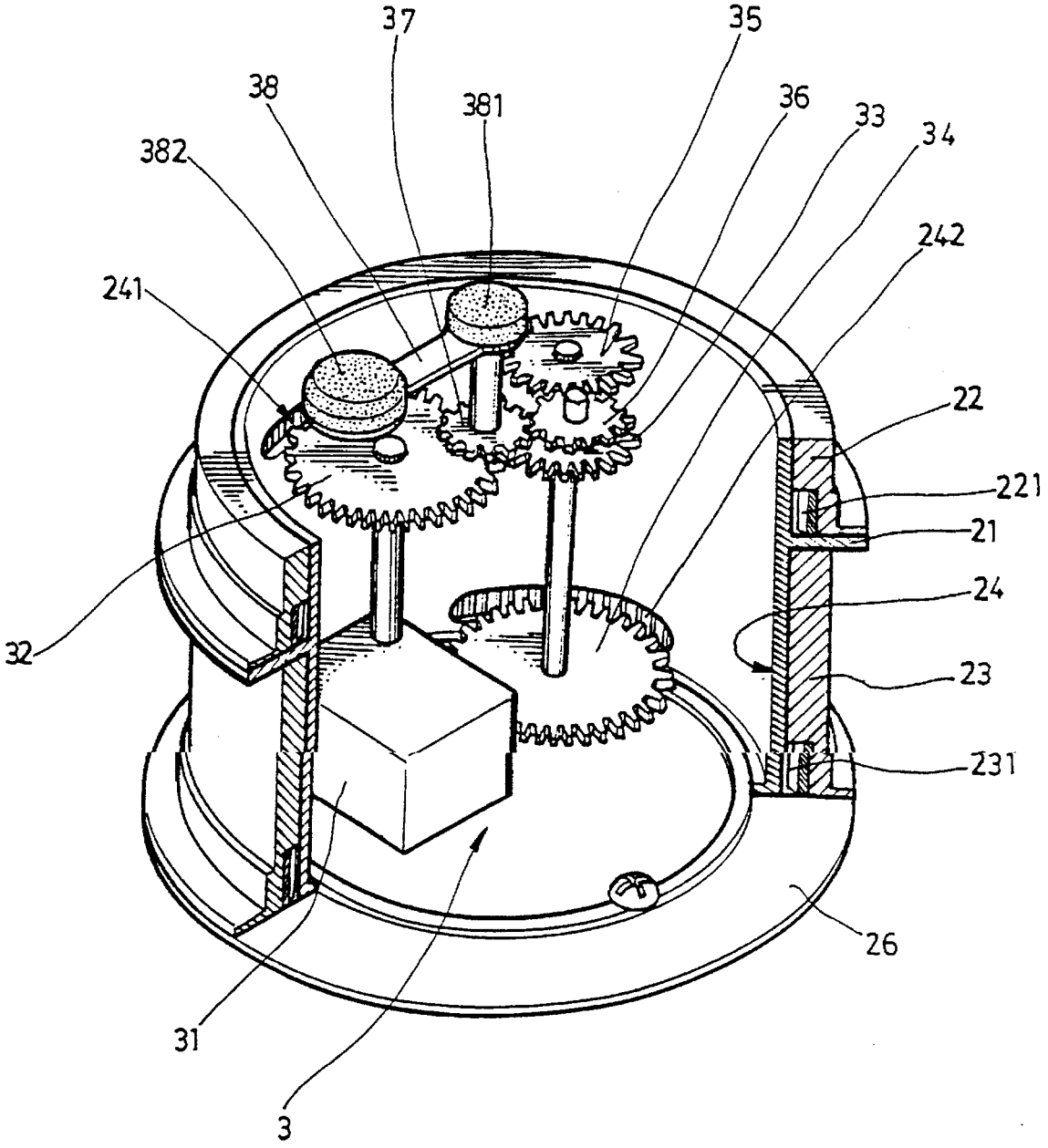
FIG. 2 is a perspective view of the base portion of the present invention with a part of which being cut away to better show the driving mechanism thereof.
Figure 3:
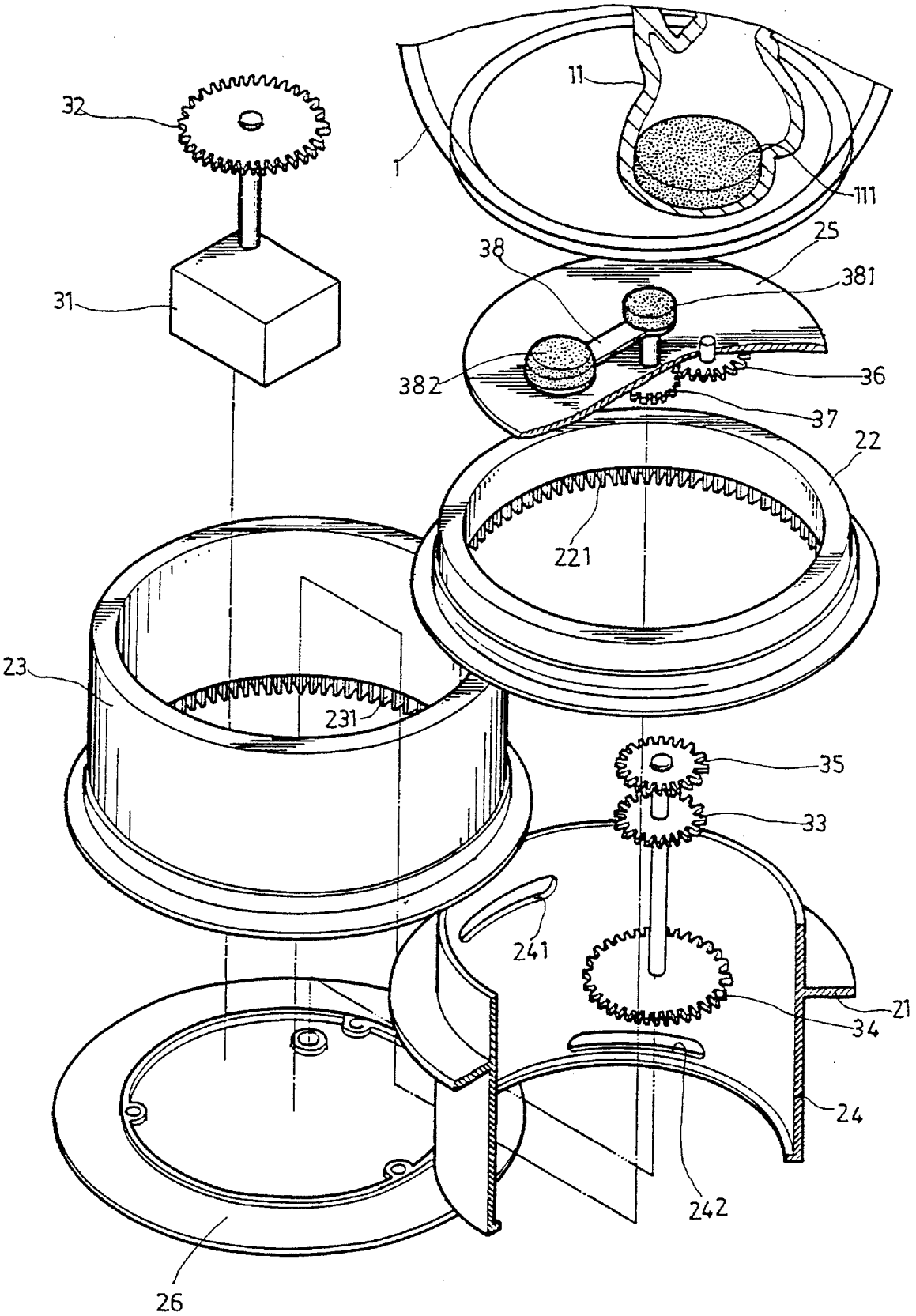
FIG. 3 is an exploded perspective view of the base portion of the present invention, a part of which has been cut away to better show the internal structure thereof.
Figure 4:
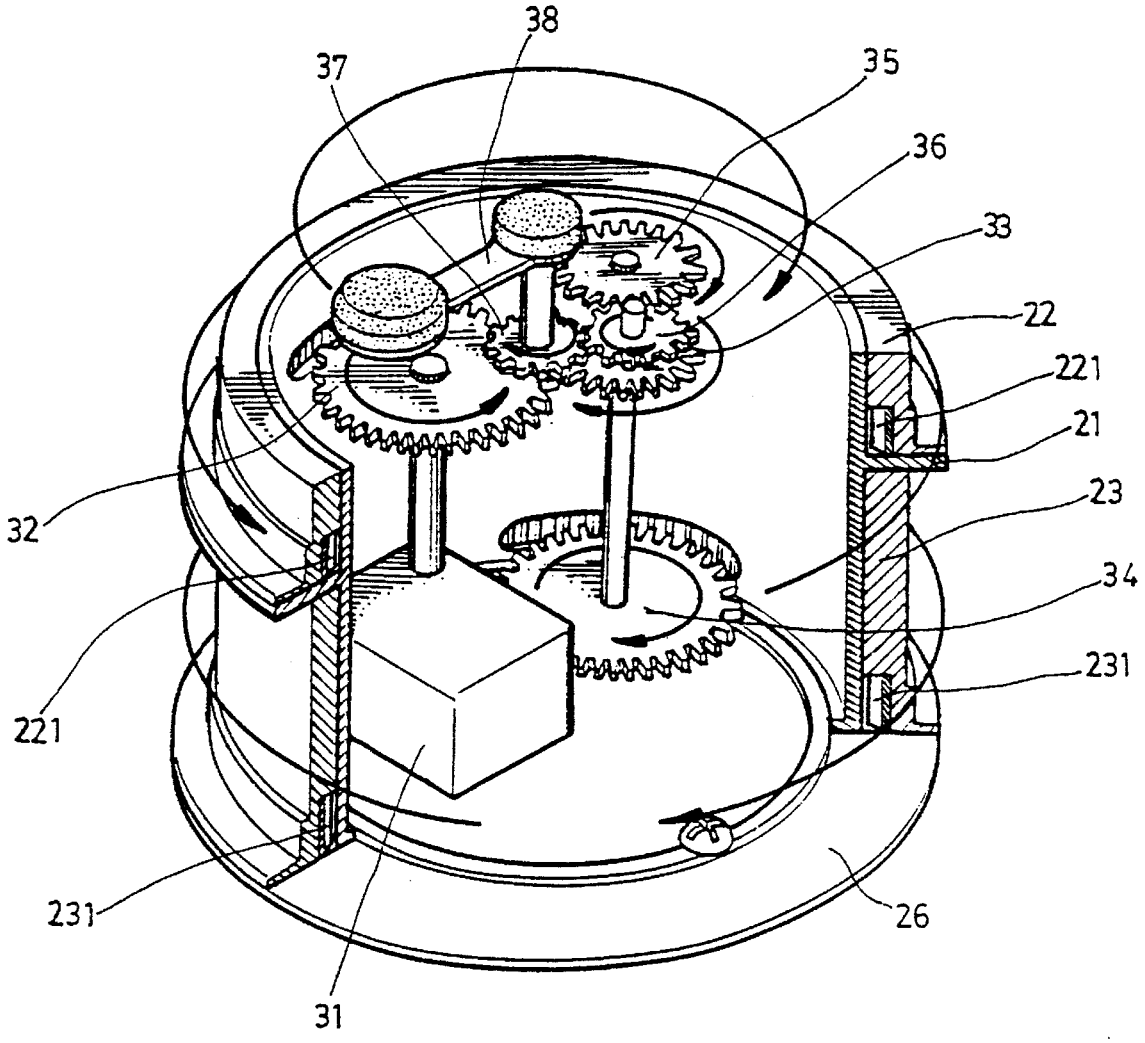
FIG. 4 illustrates the operation of the base portion and the driving mechanism of the present invention.

Please further refer to FIGS. 2, 3, and 4 at the same time. The base portion 2 generally forms a housing and consists of the above-mentioned middle partition member 21, the upper ring member 22, the lower ring member 23, and a wall member 24. The upper ring member 22 is supported by the middle partition member 21 to surround and fitly contact with an outer periphery of an upper part of the wall member 24 while it is turnable around and relative to the wall member 24. The upper ring member 22 is formed at an inner lower peripery with a toothed surface 221. A first through hole 241 is formed on the wall member 24, allowing the toothed surface 221 of the upper ring member 22 to expose a part thereof to an internal space defined by the base portion 2. The lower ring member 23 is supported by a bottom plate 26 of the base portion 2 to surround and fitly contact with an outer periphery of a lower part of the wall member 24 while it is turnable around and relative to the wall member 24. The lower ring member 23 has a structure similar to that of the upper ring member 22 and is formed at an inner lower periphery with a toothed surface 231. A second through hole 242 is formed on the wall member 24 at a position lower than that of the first through hole 241, allowing the toothed surface 231 of the lower ring member 23 to expose a part thereof to the internal space defined by the base portion 2. To simplify the manufacture of the toothed surfaces 221 and 231, two separate ring members with toothed inner periphery can be additionally adhered to the inner lower periphery of the upper and the lower ring members 22, 23.

The driving mechanism 3 includes a main spring barrel 31 and a gearset. The main spring barrel 31 can also be replaced by a motor. The gearset includes gears 32, 33, 34, and 35. The gear 32 is directly driven by the main spring barrel 31 and meshes with the gear 33 to cause the latter to rotate along with it. The gears 33, 34 and 35 are mounted on the same rotary shaft and therefore rotate synchronously. The gears 32 and 34 are positioned adjacent to the first and the second through holes 241 and 242 of the wall member 24, so that they can mesh with the toothed surfaces 221 and 231 of the upper and the lower ring members 22, 23, respectively. Since the rotary shafts supporting the gear 32 and the gears 33, 34, and 35, respectively, are specially designed to extend and stably rotate between a top plate 25 and the above-mentioned bottom plate 26 of the base portion 2 with the gears 32 and 34 meshing with the toothed surfaces 221 and 231, respectively, the upper and the lower ring members 22, 23 are brought to rotate around the wall member 24.

Another two meshed gears 36, 37 are mounted on two rotary shafts which are rotatably fixed to a bottom side of the top plate 25 respectively. The gear 36 meshes with the gear 35 and is driven to rotate by the rotating gear 35. The gear 37 is positioned near a central point of the base portion 2 and is driven to rotate by the rotating gear 36. As can be clearly seen from FIG. 2, the rotary shaft of the gear 37 upward projects from the top plate 25 and ends, at a point near an outer bottom surface of the ball portion 1. An arm member 38 is connected at one end to a top end of the rotary shaft of the gear 37 above the top plate 25 to horizontally and radially extend an adequate distance. Magnets 381 and 382 are respectively attached to the connecting end and the other free end of the arm member 38 with two magnetic poles at each upper side of the magnets 381, 382 different from each other. That is, the magnets have different poles at the side facing the bottom surface of the ball portion 1. Thereby, when the arm member 38 pivotally rotates along the gear 37, the magnets 381, 382 generate a changeable magnetic field in the ball portion 1 closely located above them. This magnetic field provides the force to move the ornament 11 inside the ball portion 1.

The ornament 11 is preferably made to be a hollow shell of any shape or configuration. A magnet 111 with adequate weight is disposed inside the shell at a bottom portion, so that a buoyancy provided by the air inside the shell and a load created by the magnet 111 generate a torque which permits the ornament 11 to always keep an upright position in the liquid contained in the ball portion. The magnet 111 has a bottom side having a magnetic pole different from that at the top side of the magnet 382 and the same as that at the top side of the magnet 381. Moreover, the ornament 11 is preferably designed to have a spherical bottom surface to reduce its frictional contact with the ball portion 1. The weight of the magnet 111 is so selected that it permits the ornament 11 to have a buoyancy which allows the ornament 11 to smoothly move in the ball portion 1 under an action of the distant magnetic force of the rotating arm member 38 in the base portion 2. Since the magnet 111 in the ornament 11 has a lower magnetic pole the same as the upper magnetic pole of the magnet 381, the ornament 11 is always pushed outward. And, since the lower magnetic pole of the magnet 111 is different from the upper magnetic pole of the magnet 382, the ornament 11 is always attracted by the rotating magnet 382 to revolve inside the ball portion 1 near an outer area thereof. The minor frictional resistance existing between the bottom surface of the ornament 11 and an upper bottom surface of the ball portion 1 causes the ornament 11 to rotate while it revolves in the ball portion 1. Since this is a common physical phenomenon, it is not further discussed herein.

With one single main spring barrel or motor to provide necessary dynamics, the liquid ball of the present invention can be actuated, causing the ornament inside the ball to dynamically revolve and rotate on the liquid surface and the decorative ring members to rotate around the base portion, giving the decoration a double decorative effect.

What is claimed is:

1. A liquid ball for providing a dynamic view, comprising: a ball portion for containing a liquid and a magnet-containing ornament therein, a base portion attached to a bottom side of said ball portion and defining an inner space therein, and a driving mechanism accommodated inside said inner space in said base portion;

said base portion having: a top plate; a wall member with an upper through hole and a lower through hole; and an upper decorative ring member and a lower decorative ring member rotatably mounted around said wall member, said upper and lower ring members both having an outer surface and an inner periphery with a toothed surface, said upper decorative ring located such that portion of sad toothed surface extends over the upper through hole and said lower decorative ring located such that a portion of said toothed surface extends over said lower through hole; and said driving mechanism comprising: a power source and a gearset rotated by said power source said gearset including an upper gear meshing with the toothed surface of said upper decorative ring through said upper through hole and a lower gear meshing with the toothed surface of said lower decorative ring through said lower through hole; said upper gear being directly rotated by said power source thereby causing said upper ring member to rotate, said lower gear being rotated by rotation of said upper gear thereby causing said lower ring member to rotate;

a central gear disposed closely below said ball portion rotated by said upper gear, said central gear connected to a rotary shaft which projects through said top plate of said base portion; a horizontally and radially extending arm member connected to the rotary shaft, the arm member having two ends; a magnet attached to each end of said arm member with magnetic poles at a top side of said magnets different from each other, whereby said two magnets on said arm member produce a changeable magnetic field in the ball portion when said arm member rotates along with said central gear and said gearset is rotated by said power source, and said magnetic field causes said magnet-containing ornament to revolve and rotate in said liquid in said ball portion.

* * * * *